United States Patent [19]

Angioletti et al.

[11] 4,186,736

[45] Feb. 5, 1980

[54] DEVICE FOR SAFEGUARDING THE RESPIRATORY ORGANS

[75] Inventors: Attilio Angioletti; Giosue Citelli, both of Milan, Italy

[73] Assignee: Industrie Pirelli S.p.A., Milan, Italy

[21] Appl. No.: 836,729

[22] Filed: Sep. 26, 1977

[30] Foreign Application Priority Data

Oct. 4, 1976 [IT] Italy ..... 27951 A/76

[51] Int. Cl.[2] ..... A62B 18/04

[52] U.S. Cl. ..... 128/201.19; 128/201.25

[58] Field of Search ..... 128/142.7, 142.6, 142.5, 128/142.4, 142.3, 142.2, 142 R, 141 R, 141 A, 205, 139; 2/414, 171.3

[56] References Cited

U.S. PATENT DOCUMENTS

| | | | |
|---|---|---|---|
| 3,258,010 | 6/1966 | Austin et al. | 128/142.7 |
| 3,433,222 | 3/1969 | Pinto | 128/142.2 |
| 3,502,074 | 3/1970 | Jones et al. | 128/142.5 |
| 3,963,021 | 6/1976 | Bancroft | 128/142.7 X |
| 4,081,865 | 4/1978 | Bergee et al. | 2/414 X |

*Primary Examiner*—Henry J. Recla

*Attorney, Agent, or Firm*—Stevens, Davis, Miller & Mosher

[57] ABSTRACT

A device for protecting the head and respiratory organs is disclosed comprising a casque having a transparent bubble-screen, a headgear made of a flexible cellular material placed inside the casque, an electrically powered ventilating device for forcing in filtered air for respiration, at least one container for holding a filtering block, the said device comprising also a battery, and at least one exhaust valve, and wherein the said headgear comprises slots for housing at least the ventilating device for forcing the filtered air for respiration, and placed in such a manner that the weight of the ventilating device rests directly on the headgear itself.

4 Claims, 4 Drawing Figures

DEVICE FOR SAFEGUARDING THE RESPIRATORY ORGANS

The present invention relates to improvements in devices intended for safeguarding the head and the respiratory organs. In particular, it relates to devices comprising a casque or helmet provided with ventilating means for admitting fresh air for breathing purposes.

A typical environment where the casque of this invention may be put to advantageous use is in work spaces where people require protection for their lungs and eyes against direct contact with toxic gases and powders which may prove hazardous to health and well-being. Moreover, the casque is also handy as a protection against falling objects, or other dangerous substances such as, for example, liquid sprays.

Devices of the type just mentioned comprise a plurality of elements, including a casque provided with a transparent bubble-screen; an electrical ventilating means; a conduit for expelling stale air from inside the casque to the outside; a battery; a filtering-block with its associated container; a headgear; and at least one exhaust valve.

The combination of elements, and their association and location on the casque, cause various problems which are substantially related to the sensation of heaviness felt on the wearer's head—resulting, in the circumstances, in a tendency to be unable to endure remaining for over a relatively short period of time in spaces where the casque has necessarily to be worn. Moreover, the rather limited field of vision causes a sensation of insecurity to the wearer; and what is more, its excessively complicated and cumbersome nature only succeeds in provoking fatigue in breathing to the wearer.

As can be seen the problems involved are many, and all the solutions tend more or less to overcome some disadvantages but at the cost of giving rise to others.

The aim of the present invention is, therefore, a device for protecting the head and respiratory organs by resolving at one and the same time all the previously stated disadvantages in a highly satisfactory manner.

The object of the present invention is a device for protecting the head and the respiratory organs comprising a casque or helmet with a transparent bubble-screen, a headgear of a flexible cellular material placed inside the said casque, and means for forcing in filtered air for respiration, comprising an electrical ventilating-device, at least one container for holding the filtering-block, the said device comprising in addition, a battery, and at least one exhaust valve, characterized by the fact that said headgear comprises slots, at least for housing the said means for forcing in filtered air for respiration, and placed in such a way that the weight of the said means rests directly on the headgear itself.

In a preferred embodiment, the said device is characterized by the fact that the said headgear comprises an air-feeding slot for taking the air from the filtering-block to the ventilating means, and another air-feeding slot for taking the already-filtered air from the ventilating means towards the respiratory organs.

The device mentioned above constitutes a great improvement with respect to those devices used up to the present for safeguarding men who are obliged to work in contaminated environments.

In fact, this headgear comprises slots—explained later on in more detail—within which are housed all the means for admitting filtered fresh air for respiration. In this way the weight, being now subject to be borne by the flexible cellular material of the headgear itself, practically does not impose on the wearer any feeling of heaviness on his own head.

Moreover, since the headgear itself also includes an element which admits air through appropriate inlets made into the very material of the headgear, there is thus the added advantage of having a device devoid of any rubber tubes, or the like, conventionally used for admitting air by means of the ventilating device and from there to be breathed in by the wearer.

As a consequence, the casque according to the present invention is a simple, portable and inexpensive unit. In particular, the arrangement of all the main elements around the headgear (as described more fully hereinafter) assures an ample free space in the front part of the casque for disposing a transparent bubble-screen endowed with a wide-visibility range for allowing the wearer to look around him with great facility.

The present invention will be still better understood by reference to the following detailed description in conjunction with the accompanying drawings by way of non-limiting example:

Figure 1:
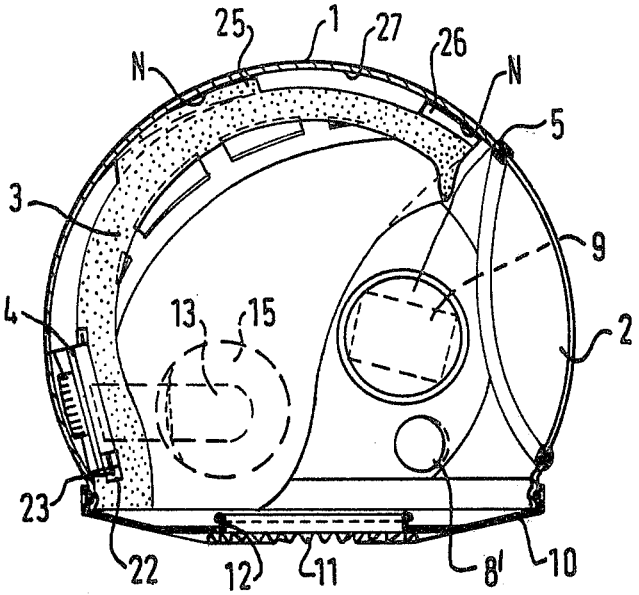
FIG. 1 shows a section substantially along the symmetrical vertical plane of the device.
Figure 2:
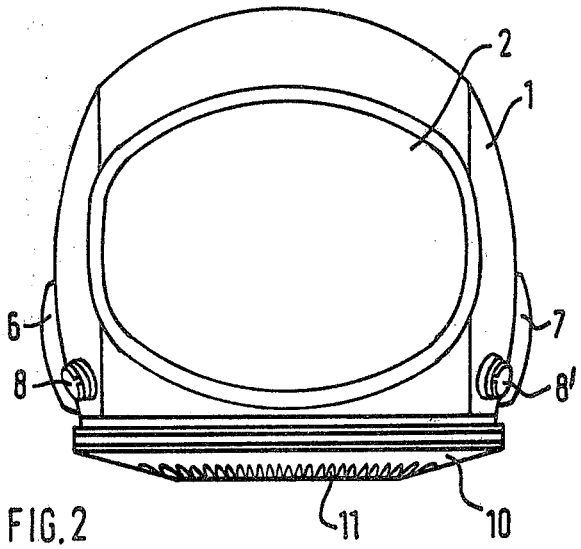
FIG. 2 shows a frontal view of the device.

More particularly, in FIGS. 1 and 2 there is shown a device according to this invention comprising a casque 1 made of a plastic or metallic material, and comprising a transparent bubble-screen 2, a headgear 3 made of a cellular material such as a flexible polyurethane foam placed inside the casque, means for forcing in air for respiration, comprising an electrical ventilating device 4 for admitting fresh air for the wearer's breathing purposes, two containers 6 and 7 (FIG. 2) inside each of which is placed an appropriate filtering-block or cartridge for purifying the outside air brought in by the ventilating device 4. Slots made in the headgear, as explained before, are capable of housing the said means for forcing in filtered air for respiration, in such a way that their weight is borne directly by the headgear itself.

The device comprises further a conventional long-lasting self-contained battery 5 for operating the ventilating-device 4, two exhaust valves 8 and 8′ of the type having a membrane of the kind normally used in anti-gas masks, a phonic apparatus 9 (FIG. 1) consisting, for example, of a group of amplifiers for the wearer's voice and/or an apparatus for receiving the sounds coming from outside the casque itself.

The casque 1 is sealed along its lower portion by a rubber collar 10, the corrugated surface 11 of which is easily deformable elastically, in order to allow with the aid of the expanding action of the associated rubber ring 12 for the wearer's head to pass therethrough.

Figure 3:
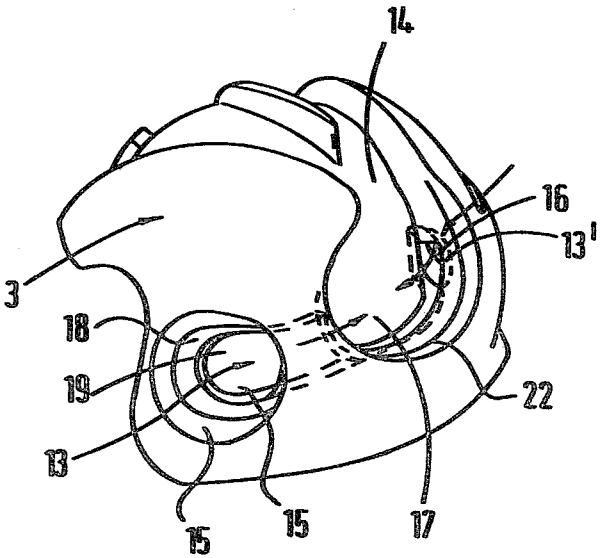
FIG. 3 shows a perspective view of the headgear only of the device.

FIG. 3 gives a perspective view of the headgear 3, comprising air-feeding slots made into the very material of the headgear itself, for admitting fresh air; and more precisely, a first and a second conduit 13 and 13′ and also a canal 14.

The first and second conduits 13 and 13′ extend laterally with respect to the internal part of the lower portion of the headgear, starting with the housings for the containers represented by two lateral cavities 15 and 16, and leading to the single cavity for the ventilating device 4, represented by the central opening 17 placed in the lower portion and rear of the headgear 3.

The canal 14 extends along the entire external surface of the headgear 3 relative to its median zone, departing from the opening 17. It is provided to convey fresh air, which comes in already filtered and sucked in through the opening 17, towards the respiratory organs.

Figure 4:
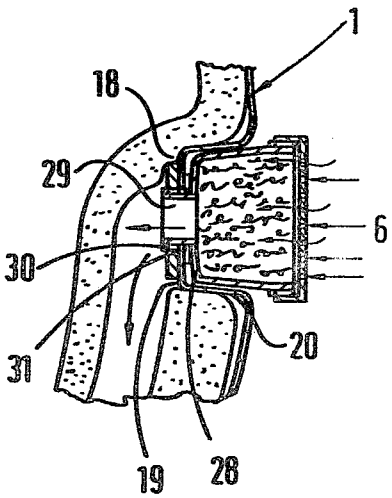
FIG. 4 represents an arrangement for connecting the containers holding the filtering-block to the casque itself, shown in a partial transversal section of the device.

Each of the cavities 15 and 16 comprises a flange 18 having a central hole 19 suitable for receiving, as explained later on, a re-entrant hollow having a central hole having a corresponding form 20 (FIG. 4) existing on the surface of the casque, appropriately provided for housing the container within which is enclosed the filtering-block or filter cartridge.

The air-feeding slots for the ventilating device 4, comprise the central opening 17, along the walls of which a hollow space is provided for housing an appropriate flange 23 (FIG. 1) of the casing for the ventilating device 4.

The headgear may also include additional slots for holding any other devices that may be desired or required to help the wearer with his work, or which is adapted for assisting the air to circulate—for example a battery for operating the ventilating device 4.

In a preferred embodiment, both the battery 5 and the communications device 9 are inserted into the inner surface of the casque 1 (FIG. 1) for facilitating the work of maintenance.

The mounting of the various parts of the casque proceeds as follows: the ventilating-device 4 is introduced into the headgear 3 (FIG. 1) by inserting the flange 23 inside the casing of the ventilating-device 4 in the circular hollow 22.

Following this, and in a way known per se, the battery 5 connections, that are already provided in the casque 1, are attached to the ventilating-device 4, as well as to the other elements which comprise electrical parts, as for example the phonic apparatus 9, conventional switches, etc.

Then the headgear is put into the casque in such a way that each of the two re-entrant lateral hollows 20 (FIG. 4) existing on the surface of the casque are inserted into the cavities 15 and 16.

During this operation, the joining of the headgear to the casque can be done in various ways, for example, by providing on the ribs 25 and 26 (FIG. 1) of the headgear 3 some adhesive tapes N for achieving adhesion to the internal walls 27 of the casque 1.

The filtering-blocks are then attached by inserting the respective containers 6 and 7 into the two re-entrant hollows 20 of the casque (FIG. 4) and by fastening them with appropriate joining means, for example, by providing the base 28 of each container with a tubular conduit 29 that communicates at one extremity with the inside of the container itself, i.e., with the filtering-block, while a screw thread 30 screws into an appropriate screw-thread part 31 in the hole of the re-entrant hollow 20 of the casque.

In this way, at the conclusion of the cited assembly operation through the joining means described above the containers holding the filtering-block are tightly secured to the device itself. The collar 10 is then sealed to the edge of the casque (FIG. 1) by means of the operation already described. The device is now ready for use, and it can easily be put on by the wearer, by merely stretching the rubber ring 12 of the collar with both hands for pushing the head through.

In operation, the ventilating device 4 admits outside ambient air through the lateral cavities 15 and 16 (FIGS. 1 and 3) and the filtering-blocks act upon this entering air to purify it for breathing.

The air thus filtered passes through the lateral conduits 13 and 13' into the central opening 17, where the ventilating device 4 acts upon it, to then go through the canal 14, to the upper part of the transparent bubble-screen 2—passing across the surface of the transparent bubble-screen with the advantage of eliminating any fogging thereof—before being breathed in by the respiratory organs.

After this, the air that has been exhaled by the wearer is expelled through the exhaust valves 8 and 8'.

One important characteristic of the casque just described consists in the presence of two filtering-blocks enclosed in two separate containers, instead of just one filtering-block as is usually provided.

The provision of the two filtering-blocks allows for a greater security, healthwise, for the wearer. This is because any eventual infiltration of contaminated air—due perhaps to a defective adjustment or functioning of any one container—would be balanced because the vitiated air would then be admixed with the purified air that is being supplied by the second filtering-block.

On the other hand, the increased weight represented by the presence of the two filtering-blocks with their associated containers is practically negligible, both because weight is now to be exercised on the cellular material of the headgear itself, and because of the balanced disposition of these two filtering-blocks that are placed in a symmetrical position with respect to each other and with respect to the plane of symmetry of the casque itself.

In a preferred embodiment, the two containers with their associated filtering-blocks are disposed on the axis that crosses the axis of rotation of the wearer's head. In this way are eliminated any lever arms of the containers, with respect to the axis of rotation of the wearer's head.

Moreover, the device of the present invention has the added advantage of including a ventilating device that is supported by a material that is elastic as well as acoustically insulated at the same time. Hence, the feeling of annoyance, etc., that is usually felt by the wearer when the ventilating-device is functioning, is prevented.

Another important aspect of the device described above, lies in the fact that should any objects fall accidently upon the wearer's head, the actual impact is considerably lessened by virtue of the presence of the flexible cellular material used for the construction of the headgear.

In particular, it is also evident that the ample surface of the headgear, as clearly illustrated in the accompanying drawings, allows for obtaining a perfectly fitting device for the wearer's head, with no further need for such accessories as cumbersome rubber straps for holding the headgear in place.

The device representing the present invention is designed to be used in the presence of noxious powders and aerosols e.g., in an atmosphere where varnishing work is being carried out. Since the filter is used to entrap lacquer particles and solvent vapors, the filter used to entrap the vapors are based, e.g., on activated carbon.

In other potential areas of use, it is to be noted that filters for entrapping aerosol use treated felts while filters for anti-powders use synthetic foam or chemically treated felt. Both can be used in the device described herein. The present device can be used as a protection aid in the presence of carbon monoxide (CO), sulfur dioxide ($SO_2$), for noxious gases, fumes and acid vapors. Filters with special granules can be used against aggressive chemicals.

What is claimed is:

1. A helmet for protecting the head and respiratory organs comprising a rigid outer shell having an open lower portion adapted to fit over the head of a user and provided with a transparent screen across the front portion thereof, a headgear of flexible cellular material placed inside said shell, sealing means connected to the open lower portion of said rigid outer shell and adapted to be secured about the neck of the wearer, containers housing filtering blocks sealingly connected to said rigid outer shell, a ventilating device contained in said helmet, conduits inside said helmet for conveying the filtered air from the filtering blocks to the ventilating device and at least one air passage for conveying the filtered air from the ventilating device to the respiratory organs, whereby air enters the helmet through the filtering blocks, flowing in the conduits recalled by the ventilating device and being sent to the respiratory organs via the air passage, a communications device, a battery operatively connected for supplying electric current to said communication and said ventilating devices and at least one exhaust valve on said helmet for the elimination of air from the helmet, characterized by the fact that:

a slot is present on the external surface of the headgear farthest from the transparent screen and in correspondence of the plane of symmetry of the helmet vertically dividing the transparent screen into two parts, said ventilating device being mounted on the lateral surface of the rigid outer shell and located in said slot of the headgear which is on the side opposite to the transparent screen, with respect to the plane of symmetry substantially parallel to the transparent screen and symmetrically placed with respect to the plane of symmetry of the helmet vertically dividing the transparent screen, are present means for housing and fixing said containers housing filtering blocks, on a first lateral surface of the rigid outer shell which is on the same side as the transparent screen, with respect to the plane of symmetry substantially parallel to the transparent screen and symmetrically placed with respect to the plane of symmetry of the helmet vertically dividing in two the transparent screen are present means for housing said communication device and on a second lateral surface of the rigid outer shell facing said first lateral surface are present means for housing said battery for supplying electric current to said communication device and ventilating device, sealing means comprising an elastically deformable rubber collar sealingly connected to the lower periphery of said open lower portion of the rigid outer shell and intended to sealingly press around the wearer's neck, whereby all the space inside the helmet is in communication with the outside atmosphere only through the filtering blocks and the exhaust valve and the center of gravity of the helmet coincides with the oscillating center of the neck of the wearer so that the helmet is perfectly balanced on the head of the wearer with respect to whatever position is assumed by the head of the wearer itself.

2. The helmet of claim 1, wherein the conduits present inside the helmet for conveying filtered air from filtering blocks to ventilating device are cavities obtained from the flexible cellular material of the headgear itself and the canal for conveying filtered air from the ventilating device to the respiratory organs is obtained in the outer surface of the headgear in correspondence of the plane of symmetry of the helmet vertically dividing in two the transparent screen whereby the ventilating device cannot recirculate the air already present within the helmet.

3. The helmet of in claim 1 wherein the means for housing the containers housing filtering blocks present on the lateral surface of the rigid outer shell and of the headgear are a re-entrant hollow with a central hole obtained on the internal lateral surface of the rigid outer shell adopted to house the said containers housing filtering blocks and a corresponding cavity, for receiving said re-entrant hollow, comprising a flange having a central hole obtained in the lateral external surface of the headgear.

4. The helmet of in claim 3 wherein the two containers housing filtering blocks are disposed on the horizontal axis substantially parallel to the transparent screen crossing the vertical oscillating axis of the wearer's head.

* * * * *